US006284145B1

(12) United States Patent
Andersson

(10) Patent No.: US 6,284,145 B1
(45) Date of Patent: Sep. 4, 2001

(54) SCREEN PLATE FOR SCREENING OF A PULP SUSPENSION AND METHOD TO SEPARATE THE SAME

(75) Inventor: Roine Andersson, Järfälla (SE)

(73) Assignee: GL&V/Celleco AB, Stockholm (SE)

( * ) Notice: Subject to any disclaimer, the term of this patent is extended or adjusted under 35 U.S.C. 154(b) by 0 days.

(21) Appl. No.: 09/202,142

(22) PCT Filed: Apr. 20, 1998

(86) PCT No.: PCT/SE98/00719

§ 371 Date: Dec. 9, 1998

§ 102(e) Date: Dec. 9, 1998

(87) PCT Pub. No.: WO98/48103

PCT Pub. Date: Oct. 29, 1998

(30) Foreign Application Priority Data

Apr. 21, 1997 (SE) ..... 9701474

(51) Int. Cl.[7] ..... B01D 29/31; B01D 39/20

(52) U.S. Cl. ..... 210/767; 210/498; 210/499; 210/402; 210/403; 162/52; 162/251

(58) Field of Search ..... 210/767, 498, 210/499, 402, 403; 209/273; 162/55, 251

(56) References Cited

U.S. PATENT DOCUMENTS 4,876,008 * 10/1989 Tikkanen ..... 210/498
4,954,249 * 9/1990 Gero et al. .
5,472,608 * 12/1995 Kruger et al. ..... 210/498

FOREIGN PATENT DOCUMENTS 0 287 267 10/1988 (EP) .
WO 90/01983 3/1990 (WO) .
WO 93/07334 4/1993 (WO) .

* cited by examiner

*Primary Examiner*—W. L. Walker
*Assistant Examiner*—Marianne Ocampo
(74) *Attorney, Agent, or Firm*—Browdy and Neimark

(57) ABSTRACT

A screen plate (1) for screening of pulp suspensions, comprises a number of elongated at least partially curved screen slots (3). According to the invention every screen slot has a width which is maximally 0.8 mm, and the screen slots bend in such a way that a straight rod, which has a breadth which is less than the width of the screen slot and the length which is 5 mm, is prevented from passing through the screen slot, when the rod extends along the screen plate, independently of how this rod is oriented in relation to the screen slot. At that elongated stiff shives may be separated more efficiently by means of the screen plate. This screen plate may also be used for separating a pulp suspension into a first fraction comprising comparatively stiff fibers and a second fraction comprising comparatively flexible fibers.

19 Claims, 1 Drawing Sheet

SCREEN PLATE FOR SCREENING OF A PULP SUSPENSION AND METHOD TO SEPARATE THE SAME

Figure 2:
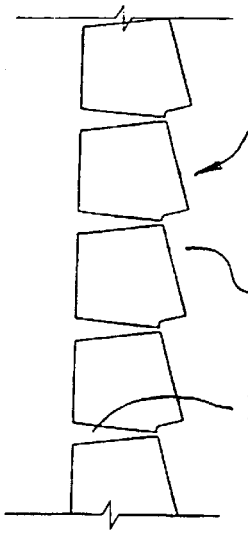

The present invention relates to a screen plate for screening of a pulp suspension, comprising a number of elongated at least partly curved screen slots. The invention also relates to a method of separating a pulp suspension into a first fraction comprising comparatively stiff fibers and a second section comprising comparatively flexible fibers.

Screen plates are mainly used for separation of comparatively coarse contaminants from pulp suspensions, at which the width of the slots is dimensioned such that the fibers may pass through the screen slots while the coarse contaminants are hindered. In order to reach a good separation efficiency the screen slots should have a width which is not larger than ca.0, 1–0.3 mm. In spite of the fact that a separate wood fiber, as for example soft wood fibers, may be up to 5 mm long it may pass through such a comparatively small screen slot, which is due on one hand that the fiber is only 15–40 um broad, on the other that it is also more or less flexible and may therefore be bent along the screen slot.

Among coarse contaminants are also counted so called shives which consist of small bundles of fibers sticking together, which stuck-together fibers also may be up to 5 mm long. Shives which are broader than the width of each screen slot are of course always separated by the screen plate. Also shives which are smaller than the screen slots are separated by the screen plate if the shives cross the screen slots, since the shives are stiff. One problem in this connection is however that comparatively small shives may pass through the screen slots if they are oriented along the same. Remaining shives in the screened pulp suspension create indications of fracture in the paper which is produced from the pulp suspension, which impairs the quality of the paper. Another problem is that thin flexible contaminants as plastic flakes and fragments of sheets may turn an edge against the screen plate and pass the screen slots in that way.

The quality of paper is also influenced by its fiber composition. Consequently a pulp suspension which is produced from softwood contains comparatively flexible fibres from early wood, which are produced during the spring season when the trees grow rapidly, and comparatively stiff late summer fibers, which are produced during summer and autumn season when the trees grow more slowly. Early wood fiber are suitable to use for paper of the kind which shall have a tight strong structure and an even surface, while the late summer fibers are suitable for paper of the kind which shall have a comparatively high stiffness but do not have to meet high demands on tightness and strength. For example a cardboard consisting of a three layer paper laminate could advantageously be made up of two outer, thin tight paper layers of early wood fibers with an intermediate thick paper layer of sparsely distributed late summer fibers. It should also be of advantage to be able to influence the properties of the paper by mixing early wood fiber and late summer wood fiber in desired shares. At the present time there is no simple and good method to achieve the necessary introductory separation of the fibers into early wood fibre and late summer wood fibre.

Paper pulp which is produced from waste paper may comprise fibers of different kinds, both from softwood tree and hard wood tree, and from both chemical and mechanical pulp (unless the waste paper consist of high quality office paper). Most fibres from hard wood tree as for example beech, birch and some oak kinds are comparatively stiff and short which means that a large part of fibers from hard wood tree in the waste paper impairs the same as regards among all the tear resistance. In order to increase the quality of recycled paper it is therefore desired to lower the share of stiff and short fibers in the recycled paper.

A usual kind of screen plate is manufactured by milling straight parallel grooves in a plane plate with a thickness of ca. 6 mm. In each groove, where the plate consequently has a reduced wall thickness, screen slots are milled, at which the width of the screen slot is about 0.15–0.30 mm. In later time it has also been suggested that such screen slots may be formed by water cutting or laser cutting. Accordingly WO 93/07334 describes water cutting of screen slots, at which among all curved screen slots are suggested. Laser cutting of screen slots is also discussed in EP-B1-287 267, in which also curved screen slots are suggested.

An aim of the present invention is to supply a screen plate, by means of which separation of elongated particles, as fibers or shives, from the pulp suspension is considerably increased in comparison with known screen plates.

This aim is achieved by a screen plate of the kind mentioned by way of introduction, which is characterised in that each screen slot has a width which is maximally 0.8 mm and which is curved in such a way that a straight rod, which has a breadth which is less than the width of the screen slot and a length which is 5 mm, is hindered to pass through the screen slot, when the rod extends along the screen plate, independently how the rod is oriented in the relation to the screen slot.

Preferable the curved screen slots extend in parallel with each other. This brings about the advantage that the screen slots may be arranged comparatively close to each other without making the firmness of the screen plate less, which also increases the open area, that is to say the capacity of the screen plate is improved in comparison to a conventional screen plate with straight screen slots.

According to one embodiment of the screen plate according to the invention each screen slot forms a zigzag path and comprises a number of straight portions, at which adjacent straight portions in the zigzag path is connected with each other by way of curved portions of the screen slot. Alternatively each screen slot may have only one straight portion connected to a curved portion, or have two straight portions, which extend in different directions in relation to each other, at which two straight portions are connected with each other by way of a curved portion.

According to another preferred embodiment of the screen plate according to the invention each screen slot bends along its whole length. Suitably the screen slot has a bending radius, which is less than 5 mm. With screen slots formed in this way it is when screening shives in many applications possible to design the screen slot with a width up to 0.8 mm, without impairing the efficiency of separation more than unimportantly. The width of the screen slot is suitably in the interval 0.1–0.8 mm, preferably in the interval 0.2–0.6 mm. In this way the open area of this screen plate may be increased further in comparison with a conventional screen plate.

In order that shives which are considerably shorter than 5 mm, for example fibers from hard wood, may be separated with the sufficient efficiency the said bending radius should be less than 4 mm, preferably less than 3 mm.

If said bending radius is less than 0.5 mm and each screen slot has a width which is in the interval 0.1–0.2 mm, the screen plate according to the invention may be used for separation of considerably all useful fibers from a pulp suspension of waste paper, filling agents, printer's ink and very short fibers pass through the screen slot. Alternatively a cleaned pulp suspension may be dewatered by such a screen plate.

Another aim with the present invention is to present a method to separate a pulp suspension in to a first fraction comprising comparatively stiff fibers and a second fraction comprising comparatively flexible fibers. This further aim is obtained in that pulp suspension is screened with a screen plate, which is provided with a number of at least partly curved screen slots, dimensioned in such a way that each relatively stiff fibre is hindered from passing any of these screen slots, when a stiff fiber extends along the screen plate, independently of how it is orientated in relation to any of the screen slots, while each flexible fiber has a possibility to bend along some of the screen slots and pass the same.

In a screen plate with screen slots which bend in wave form or sinus form, the wavelength is not exceeding 3 mm if the screen should be used for dewatering. Should the screen plate be used for screening, that is separating shives and other undesirable contaminants, the wave length is at the most 5 mm. When the desired use is fractionation of fibers the wave length has a maximum value between 3–5 mm.

Figure 1:
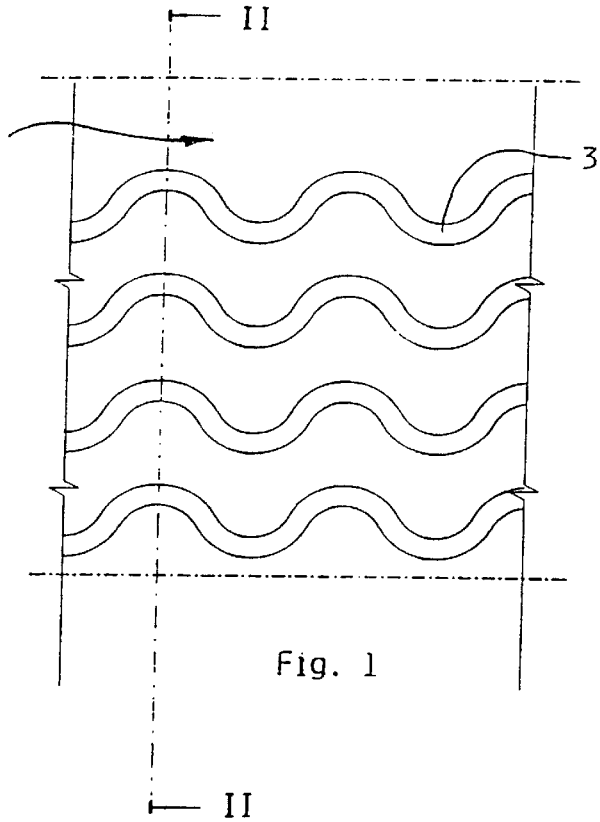
Figure 4:
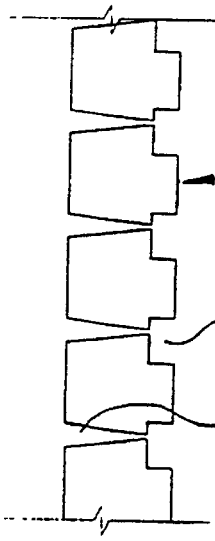
Figure 3:
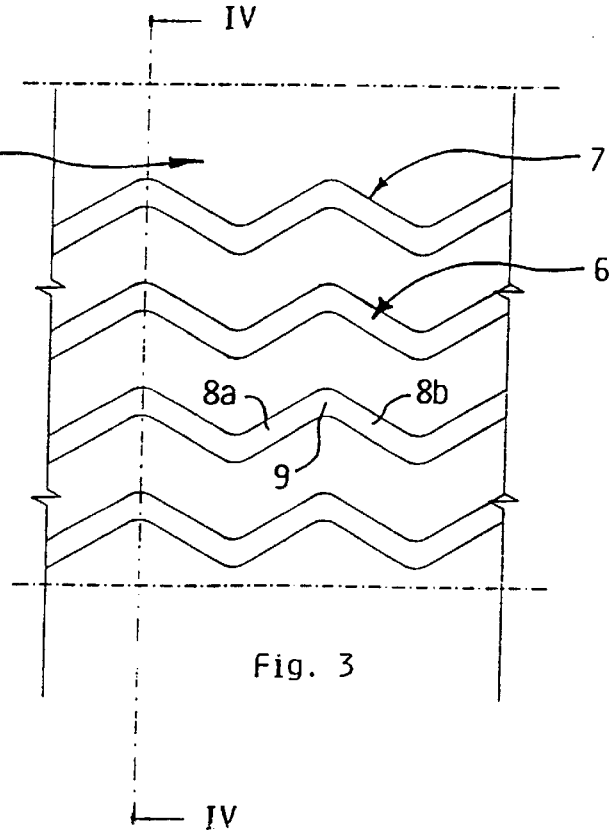

The invention is described further in the following with the reference to attached drawing in which FIG. 1 shows an enlarged part of a preferred embodiment of a screen plate according to the invention, FIG. 2 shows a section along line II—II in FIG. 1, FIG. 3 shows an enlarged part of another embodiment of the screen plate according to the invention, and FIG. 4 shows a section along a line IV—IV in FIG. 3.

FIGS. 1 and 3 are drawn in a larger scale than FIGS. 2 and 4.

In FIG. 1 there is shown a plane-parallel screen plate 1 according to the invention, which is 6 mm thick. On the inlet side of the screen plane 1 there is milled a great number of straight parallel grooves 2 with V-form in cross section. Each groove has a width of 4–5 mm. In each groove a screen slot 3 is cut through the screen plate by way of laser cutting or water cutting. The screen slots 3 extend in wave form and parallel with each other along the grooves 2. The bending radius of each slot is less than 5 mm and the width of the slots is at the most 0.8 mm. The cross section area of each screen slot 3 increases from the inlet side in order to hinder obstruction of the screen slot 3. Alternatively the cross section area may be constant along each screen slot 3.

In this case each screen slot 3 has a constant bending radius, but the bending radius may also vary along the screen slot 3, for example may each screen slot 3 bend in sinus form.

The values of the bending radius and the width of each screen slot is choosen in dependence of the result of the screening that is desired. For example the bending radius and the width of each screen slot 3 should be comparatively large if long shives of soft wood fibers should be separated or if the fibre suspension of soft wood should be separated in fractions of long late summer fibers and long flexible early wood fibers. If both long and short stiff fibers are to be separated from a fiber suspension comprising both fibers from soft wood tree and fibers from hard wood tree the bending radius and the width of each screen slot should be comparatively small. Should all fibers be separated from a pulp suspension, for example produced from waste paper, said bending radius should be less than 0.5 mm and the width of the screen slot should not be larger than 0.2 mm.

In FIGS. 3 and 4 there is shown a variant of the screen plate according to the invention comprising a plane parallel screen plate 4, the inlet side of the which is provided with a great number of straight parallel grooves 5 with U-formed cross section. In each groove 5 there is a screen slot 6 cut through the screen plate 4. The screen slots 6 form paths 7 in zigzag form, which extend in parallel with each other along the groove 5. Each screen slot 6 comprises a first number of straight parallel portions 8*a* and another number of straight parallel portions 8*b*, which extend in another direction than the first mentioned portions 8*a*. Adjacent straight portions of 8*a* and 8*b* are connected with each other by way of curved portions 9 of the screen slot 6. Each curved part 9 may have a very small bending radius, for example corresponding to the radius of the cutting laser beam or water beam. On the other hand it is so that the bending radius of each portion 9 must be much less than 5 mm in correspondence to what has been said above in relation to the embodiment according to FIGS. 1 and 2. Each straight portion 8*a*, and 8*b* must also be less than 5 mm long.

Apart from choosing suitable values of the bending radius of the curved portions 9 and widths in accordance with what is valid for the curved screen slot 3 in the screen plate1 according to FIGS. 1 and 2 suitable values for the lengths and widths of the straight portions of 8*a*, 8*b* must also be choosen in dependence of the screening results that is desired. For example each straight portion 8*a*, 8*b*, must be comparatively long and its width shall be relative large if long shives of 3fibers of soft wood tree should be separated or if a fiber suspension of soft wood tree should be separated into fractions of long stiff late summer fibers and long flexible early wood fibers. If both long and short stiff fibers should be separated from a pulp suspension containing both soft wood fibers and hard wood fibers each straight portion 8*a*, 8*b* should be comparatively short and its width comparatively small. If all fibers should be separated from a pulp suspension for example produced from waste paper, each straight portion 8*a*, 8*b* should be less than 0.5 mm and its width should not be larger than 0.2 mm.

The screen plate according to the invention is of cause not limited to the embodiments shown in FIGS. 1–4 but may be varied within the scope of the invention as the same is defined in the attached claims. Consequently the screen plate may be bent, preferably have a cylindrical shape if it should be used in a pressure screen which has rotating impulse creating means. The inlet side of the screen plate may have grooves with either V-form or U-form in cross section, independently if the screen slots is of the kind shown in FIG. 1 or FIG. 3. Alternatively the inlet side of the screen plate may miss grooves and consequently have a plane surface.

What is claimed is:

1. Screen plate for screening of pulp suspension containing straight relatively flexible fibers, wherein said screen plate has a plurality of elongated at least partly curved screen slots, each screen slot having an inlet edge and an outlet edge and defining a flow path that extends in a direction between, and perpendicular to, the inlet and outlet edges, wherein each screen slot has a width not greater than 0.8 mm and is bent into a configuration selected such that a straight stiff fiber having a length of 5 mm and lying in a plane perpendicular to the flow path direction cannot pass into any one of said screen slots regardless of the orientation of the straight fiber in the plane.

2. Screen plate (1) according to claim 1, characterized in that each screen slot (3) bends along its entire length.

3. Screen plate (1) according to claim 2, characterized in that each screen slot (3) has a bending radius, which is less than 5 mm.

4. Screen plate (1) according to claim 3, characterized in that said bending radius is less than 4 mm.

5. A screen plate according to claim 4 wherein said bending radius is less than 3 mm.

6. Screen plate according to claim 5, wherein each said elongated curved screen slot (3) has a width which is in the interval of 0.2–0.6 mm.

7. The screen plate of claim 6 wherein each screen slot comprises at least a straight portion and at least one curved portion connected to said straight portion.

8. Screen plate (1) according to claim 4, characterized in that each screen slot (3) extends in wave form.

9. Screen plate (1) according to claim 4, characterized in that each screen slot (3) extends in sinus form.

10. Screen plate (1) according to claim 3, characterized in that said bending radius is less than 0.5 mm and that each screening slot (3) has a width which is in the interval 0.1–0.2 mm.

11. Screen plate (1) according to claim 2, characterized in that each elongated curved screen slot (3) has a width which is in the interval 0.1–0.8 mm.

12. Screen plate (1) according to claim 2, characterized in that each screen slot (3) extends in wave form.

13. Screen plate (1) according to claim 12, characterized in that each screen slot (3) has a constant bending radius.

14. Screen plate (1) according to claim 12, characterized in that each screen slot (3) bends in sinus form.

15. Screen plate (4) according to claim 1, characterized in that each screen slot (6) comprises at least a straight portion (8*a*, 8*b*) and at least one curved portion (9), which is connected to the straight portion.

16. Screen plate (4) according to claim 3, characterized in that each screen slot (6) comprises at least two straight portions (8*a*,8*b*) which extend in different directions in relation to each other, at which the straight portions are connected with each other by way of the curved portions (9) of the screen slot.

17. Screen plate (4) according to claim 4, characterized in that each screen slot (6) forms a path (7) in zigzag form and comprises a number of straight portions (8*a*;8*b*), at which adjacent straight portions in said path are connected with each other by way of curved portions (9) of the screen slot.

18. Screen plate (1; 4) according to claim 1, characterized in that the screen slots (3; 6) extend in parallel with each other.

19. Method of separating of pulp suspension into a first fraction comprising comparatively stiff fibers and a second fraction comprising comparatively flexible fibers, characterized in that the pulp suspension is screened by way of a screen plate (1; 4), said screen plate having a plurality of elongated at least partly curved screen slots, each screen slot having an inlet edge and and outlet edge and defining a flow path that extends in a direction between, and perpendicular to, the inlet and outlet edges, wherein each screen slot has a width not greater than 0.8 mm and is bent into a configuration selected such that a straight stiff fiber having a length of 5 mm and lying in a plane perpendicular to the flow path direction cannot pass into any one of said screen slots regardless of the orientation of the straight fiber in the plane.

* * * * *